United States Patent [19]

Myers

[11] Patent Number: 4,558,584

[45] Date of Patent: Dec. 17, 1985

[54] COMBINATION CABLE CRIMPER AND CUTTER

[75] Inventor: Robert W. Myers, Portland, Oreg.

[73] Assignee: Paul Brong Machine Works, Inc., Portland, Oreg.

[21] Appl. No.: 691,733

[22] Filed: Jan. 16, 1985

Related U.S. Application Data

[63] Continuation of Ser. No. 474,825, Mar. 14, 1983, abandoned.

[51] Int. Cl.[4] ..... B21D 7/00; B21D 41/04

[52] U.S. Cl. ..... 72/407; 72/324; 72/416; 72/453.01; 72/453.16; 7/158; 92/85 R; 92/94

[58] Field of Search ..... 72/407, 409, 410, 453.1, 72/453.01, 416, 324, 453.16; 7/125, 132–135, 157, 158; 30/180, 228; 92/85 R, 94, 64, 130 A, 63; 81/301; 29/751

[56] References Cited

U.S. PATENT DOCUMENTS

| | | | |
|---|---|---|---|
| Re. 26,834 | 3/1970 | Pawloski | 81/1 |
| 676,292 | 6/1901 | Wigtel . | |
| 1,037,918 | 9/1912 | Jacobs | 72/407 |
| 2,230,595 | 2/1941 | Horton | 92/100 |
| 2,713,850 | 7/1955 | Bradbury et al. | 92/100 |
| 2,821,170 | 1/1958 | Jacobus | 92/85 R |
| 2,840,103 | 6/1958 | Gerhardt | 92/85 R |
| 2,996,939 | 8/1961 | Meier | 81/301 |
| 3,037,208 | 6/1962 | Haberstump . | |
| 3,133,288 | 5/1964 | Ohgren . | |
| 3,328,871 | 7/1967 | Over . | |
| 3,393,438 | 7/1968 | Marley et al. . | |
| 3,487,524 | 1/1970 | Filia . | |
| 3,559,448 | 2/1971 | Illingworth et al. . | |
| 3,688,553 | 9/1972 | Demier, Sr. | 72/410 |
| 3,691,604 | 9/1972 | Spontelli | 29/252 |
| 3,804,132 | 4/1974 | Mann | 140/106 |
| 3,830,089 | 8/1974 | Boyd et al. | 72/407 |
| 3,872,528 | 3/1975 | Porter | 72/410 |
| 3,965,719 | 6/1976 | Hays | 72/409 |
| 3,972,218 | 8/1976 | Pawloski | 72/407 |
| 4,109,504 | 8/1978 | Rommel | 72/407 |

*Primary Examiner*—Daniel C. Crane
*Attorney, Agent, or Firm*—Eugene D. Farley

[57] ABSTRACT

A combination cable crimper and cutter. A frame mounts a piston for reciprocating axial movement. A reciprocating drive is connected to the piston. A pair of cable-crimping jaws is pivotally mounted on the frame and connected by links to the piston. A cutter anvil is mounted on the frame adjacent one of the jaws. A cutter is mounted on the jaw in cable-cutting relation to the cutter anvil.

3 Claims, 3 Drawing Figures

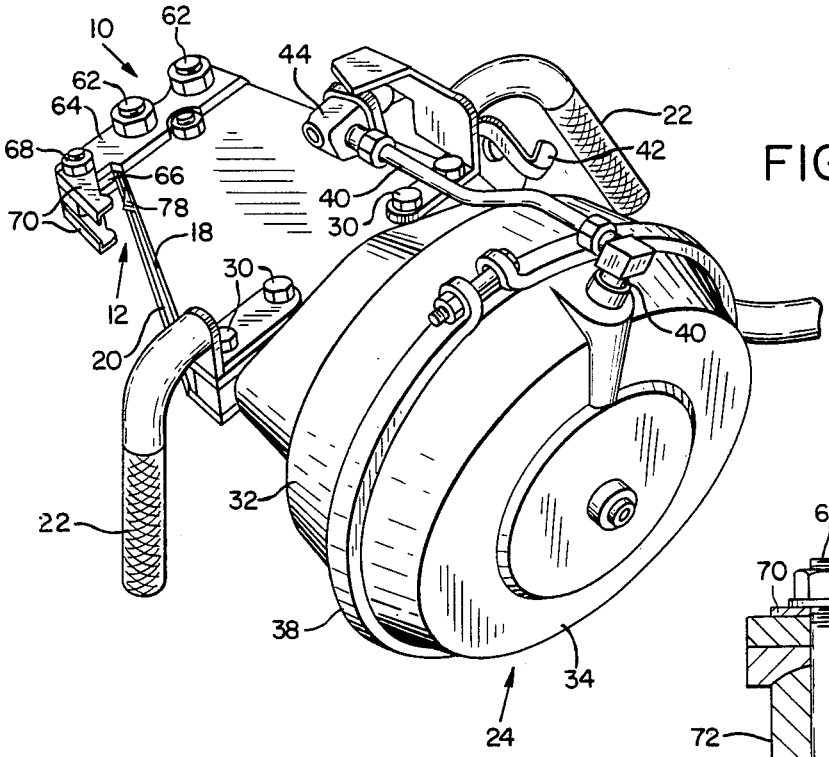
FIG. 1
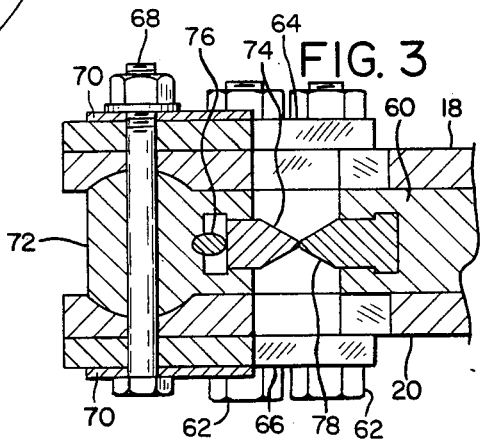
FIG. 3
FIG. 2
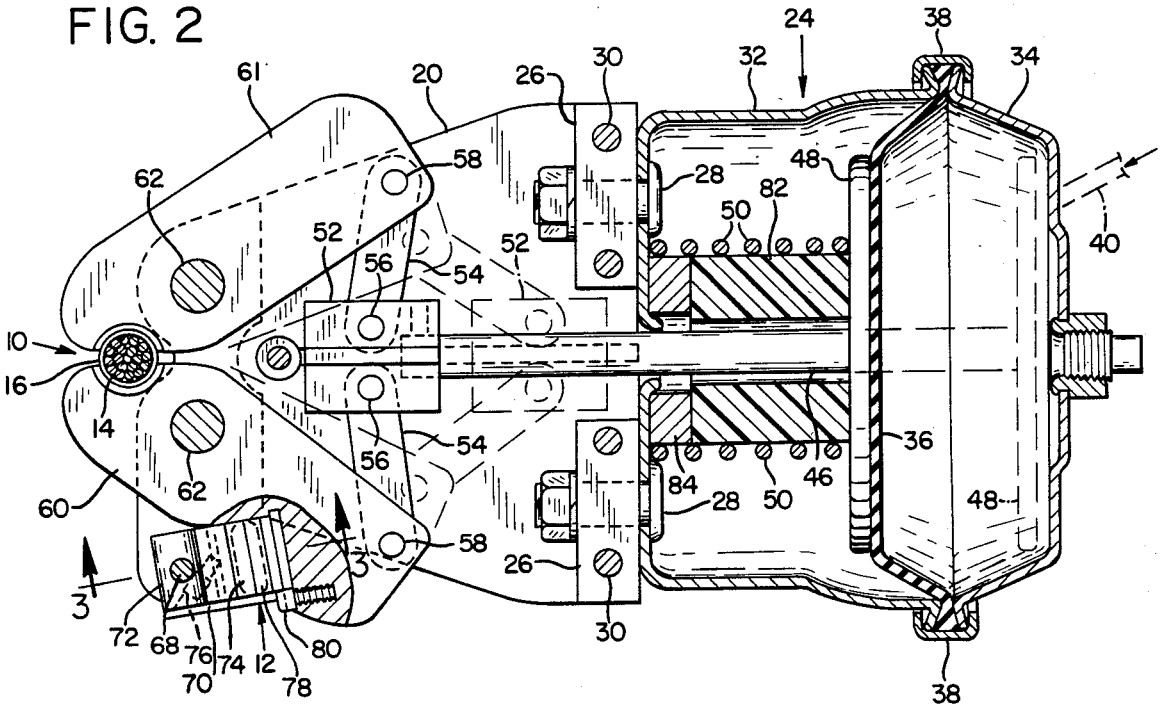

COMBINATION CABLE CRIMPER AND CUTTER

This application is a continuation, of application Ser. No. 474,825, filed Mar. 14, 1983 now abandoned.

BACKGROUND AND GENERAL STATEMENT OF THE INVENTION

This invention relates to a combination cable crimper and cutter. It pertains particularly to apparatus for crimping together the ends of cable used, for example, in containing a bundle of logs in a log raft, or on a log truck, and in cutting off the projecting cable ends.

In the logging industry it frequently is necessary to encircle a bundle of logs with a metal cable. This is accomplished by lapping the ends of the encircling cable, containing them in a ferrule, and crimping the ferrule to the cable ends for securing the resulting encircling and confining loop. Thereafter it is necessary to sever the cable from the coil supplying the same, and to snip off any projecting ends.

Such applications commonly occur when grouping logs together in a bundle to be used as a component of a log raft for transportation of the logs from place to place. It occurs also when it is desired to bundle logs on a log truck or other vehicle.

The cable employed for this purpose is of great strength and heavy gauge. Strong, rugged implements are required for the crimping and cutting operations. At the present time two tools are employed.

The first is a heavy duty, pneumatically-driven crimping tool for crimping the ferrule about the lapped cable segments. The second is a separate cable cutter, either powered or manual. For convenience, economy of operating time, and savings in tool costs, it obviously would be desirable to combine both tools into a single operating unit.

Such a combination is difficult to achieve because of the great force required to drive the cutter through a stout steel cable. Where the cutter is pneumatically driven, the forces developed during the cutting operation tend to cause failure of the tool components after only a few cycles of operation, even when a heavy duty tool is employed. Furthermore, if it is attempted to apply the tool to a crimping operation, the momentum developed by the tool components is sufficiently great to carry the drive beyond its dead center position, rendering repeated cycles of operation impossible.

It is the general purpose of the present invention to provide in a single tool a combination heavy duty cable crimper and cutter.

It is a further object of the present invention to provide a combination cable crimper and cutter including shock absorbing means for absorbing the impact of the cutting operation and returning the drive to its operating position after each cutting cycle.

It is a further object of the present invention to provide a combination cable crimper and cutter of simple, heavy duty construction and long life, which is easy and economical to operate.

The foregoing and other objects of the present invention are achieved by the provision of a combination cable crimper and cutter which comprises a frame, and a piston mounted on the frame for reciprocating axial movement. A reciprocating drive is connected to the piston.

A pair of cable-crimping jaws is pivotally mounted on the frame. Links connect the jaws to the piston.

A cutter anvil is mounted on the frame adjacent one of the jaws. A cutter is mounted on the jaw, in cable-cutter relationship to the cutter anvil. A resilient impact block is positioned for impact by the piston at the end of each power stroke of the drive, thereby preventing destruction of the tool by the shock of impact, and insuring return of the drive to its starting position after completion of each cutting cycle.

DESCRIPTION OF SPECIFIC EMBODIMENTS OF THE INVENTION

The combination cable crimping and cutting tool of my invention is described herein with particular reference to the drawings, wherein:

FIG. 1 is a view in perspective of the tool;

FIG. 2 is a longitudinal section thereof;

FIG. 3 is a fragmentary section taken along line 3—3 of FIG. 2.

As seen in FIG. 2, the crimping subassembly of the combination cable crimping and cutting tool of my invention is illustrated generally at 10 and the cutting subassembly at 12. The tool is indicated in its crimping mode of operation, the overlapped segments of cable being indicated at 14, and the ferrule in which they are contained, at 16.

Both subassemblies are mounted on a frame comprising a pair of parallel, spaced, heavy plates 18, 20. The plates mount a pair of handles 22, which render the tool portable, and a pneumatic power head indicated generally at 24.

The power head is secured releasably to spacing and support blocks 26 by means of bolts 28. Blocks 26 are secured to the plates by means of assembly bolts 30.

Power head 24 comprises a casing 32 and a casing cover 34. A diaphragm 36 is interposed between the casing and casing cover and the assembly clamped together in sealed relation by means of clamp 38. There thus is provided between the diaphragm and casing cover an air chamber which is supplied by air, or other fluid, through conduit 40. The flow of air into the chamber is controlled by means of trigger 42 and valve 44, FIG. 1.

The air chamber provided by diaphragm 36 drives a piston 46 mounted for axial reciprocation on the frame. The piston includes a piston head 48 in the form of a plate secured to diaphragm 36. A coil spring 50 is interposed between the piston head and the bottom of case 32.

The outer end of piston 46 mounts a plate or block 52 by means of which the piston is linked to the crimping and cutting subassemblies.

The inner ends of each of a pair of links 54 is pivotally connected by means of pins 56 to plate 52. The outer ends of the links are pivotally connected by means of pins 58 to a pair of heavy duty crimping jaws 60, 61.

Crimping jaws 60, 61 are mounted pivotaly between plates 18, 20 by means of pivot posts 62. Their outer extremities are formed with crimping jaws shaped and dimensioned to receive ferrule 16 and lapped cable segments 14.

So much of the hereindescribed assembly is conventional. It is the purpose of the present invention to adapt the structure described to the inclusion of cutting subassembly 12.

This is accomplished by providing on frame plates 18, 20 plate extensions 64, 66, FIG. 1. These mount, by means of bolt 68, a pair of guard fingers 70.

They also mount between them an anvil block 72, FIG. 3. The anvil block mounts a cutter anvil 74 which is held releasably in position by means of a set screw 76.

Cooperating with anvil 74 is a cutter 78. This is removably mounted in the shank end of crimping jaw member 60 by means of set screw 80. The cutter moves with the crimping jaw and, together with its associated anvil 74, imparts to the tool a cable-cutting function.

As explained above, the heavy immpact forces called into play by operation of the cutter subassembly are so great as to have two adverse effects. One is the destruction of certain elements of the tool assembly, in particular coil spring 50 and links 54. Additionally, the force of the powerful drive causes extension of piston 46 until links 54 have passed beyond their dead center position. This makes it impossible for spring 50 to retract the piston to its dashed line position of FIG. 2.

To overcome these problems, I include in my tool assembly a resilient impact block 82. This, together with support block 84, encircles and forms a housing for the upper portion of piston 46. The ends of impact block 82 bear in thrusting engagement against the under surface of piston head 48 and the upper surface of support block 84. The impact block is encircled by coil spring 50, and preferably is fabricated from a strong, shatterproof, resilient plastic such as polyurethane.

OPERATION

The operation of my combination cable crimping and cutting tool is as follows:

When at rest, the tool is in the dashed line position of FIG. 2, with diaphragm 36 and piston 46 retracted, and crimping jaw 10 and cutting jaw 12 in their open positions.

When it is desired to employ the crimping function of the tool, the two lengths of cable 14 are placed within the ferrule 16. The resulting assembly is placed in crimping jaw 10. Trigger 42 is actuated.

This extends diaphragm 36, with associated plate 48, and advances piston 46 with associated linkages and jaws 60, 61 to their full line positions of FIG. 2. In this position the ferrule is crimped to the cable.

Valve 44 acts to release the air, whereupon spring 50 returns diaphragm 48 to its dashed line position and retracts piston 46, opening the jaws.

In the next operation of the tool, the standing end of the cable is severed, and any projecting ends snipped off. This is accomplished with the tool in its dashed line position of FIG. 2, in which position the cutting subassembly 12 is in its open position. The cable length is inserted in the cutting jaw and trigger 42 actuated. Piston 46 advances, and jaws 60, 61 move to their full line position. This moves cutter 78 against anvil 74 and completes the cut.

In both crimping and cutting operations, as the piston 46 nears the end of its advancing stroke and before it reaches its dead center position, piston head 48 engages resilient impact block 82. The block is so dimensioned that it compresses slightly, absorbs the shock of impact, and assists coil spring 50 in returning diaphragm 36 to its dashed line position when air is vented from the diaphragm chamber. It thus prevents damage to the components of the tool. It also returns piston 46 from its past dead center position, and thus promotes its effective retraction.

Having thus described my invention in preferred embodiments, I claim:

1. A combination cable crimper and cutter comprising:

(a) a frame having front and rear ends and opposite lateral sides, (b) a piston mounted on the frame for reciprocating axial movement in the direction of the front and rear ends of the frame, (c) pneumatically actuated diaphragm drive means mounted on the rear end of the frame and attached to the rear end of the piston for moving the piston and the diaphragm toward the front of the frame for cable crimping and cutting operations and retracting the, piston and diaphragm in the opposite direction, (d) a pair of links pivotally connected at their inner ends to the front end of the piston, (e) a pair of cable-crimping jaws pivotally mounted intermediate their ends to the frame adjacent the front end of the frame and diverging rearwardly, terminating at their rear ends forwardly of the drive means and the rear end of the frame, (f) pivotal connecting means interconnecting the outer ends of the pair of links and the rear ends of the jaws for oscillating the jaws between open and closed position, the range of reciprocation of the piston by the drive means limiting the movement of the pivotal connecting means toward each other to a distance greater than the distance between the pivot mountings of the jaws on the frame, (g) a cutter anvil mounted on the side of the frame adjacent one of the jaws, and (h) cable cutting means mounted on said one of the jaws rearwardly of and in cable-cutting relation to the anvil for movement toward the anvil during movement of the jaw laterally outward relative to the frame.

2. The combination cable crimper and cutter of claim 1 including an enlarged piston head on the piston engaging the diaphragm drive means, and a resilient impact block positioned between the piston head and the frame forwardly of the piston head when the piston is in its rearward position and arranged for impact by the piston head at the end of its forward moving power stroke to initiate retraction of the drive means by retracting the piston and links from a forward, past dead center position.

3. The combination cable crimper and cutter of claim 2 including a coil spring interposed between the piston head and the frame and encircling the impact block, the impact block being of resilient plastic interposed between the piston head and frame and encircling the piston.

* * * * *